United States Patent [19]

Ishizuka

[11] Patent Number: 4,863,765

[45] Date of Patent: Sep. 5, 1989

[54] METHOD OF MULTI-LAYER COATING

[75] Inventor: Seiji Ishizuka, Kanagawa, Japan

[73] Assignee: Fuji Photo Film Co., Ltd., Kanagawa, Japan

[21] Appl. No.: 159,984

[22] Filed: Feb. 24, 1988

[51] Int. Cl.[4] ..... B05D 1/30

[52] U.S. Cl. ..... 427/420; 118/410; 118/411; 264/171; 264/212; 264/217; 264/298; 425/224; 427/294

[58] Field of Search ..... 264/171, 212, 216–217, 264/298, 213; 425/224; 427/420, 402, 294; 118/410, 411

[56] References Cited

U.S. PATENT DOCUMENTS

| | | | |
|---|---|---|---|
| 2,681,294 | 6/1954 | Beguin | 264/212 |
| 2,932,855 | 4/1960 | Bartlett et al. | 264/217 |
| 3,206,323 | 9/1965 | Miller et al. | 118/411 |
| 3,573,965 | 4/1971 | Ishiwata et al. | 427/402 |
| 3,928,679 | 12/1975 | Jackson et al. | 427/402 |
| 4,001,024 | 1/1977 | Dittman | 427/420 |
| 4,113,903 | 9/1978 | Choinski | 427/420 |
| 4,241,171 | 12/1980 | Clapp et al. | 427/333 |
| 4,340,621 | 7/1982 | Matsumiya et al. | 427/294 |
| 4,525,392 | 6/1985 | Ishizaki et al. | 427/420 |
| 4,569,863 | 2/1986 | Koepke et al. | 427/420 |
| 4,572,849 | 2/1986 | Koepke et al. | 427/420 |

FOREIGN PATENT DOCUMENTS

| | | | |
|---|---|---|---|
| 3238904 | 4/1984 | Fed. Rep. of Germany . | |
| 3238905 | 4/1984 | Fed. Rep. of Germany . | |
| 60-255172 | 12/1985 | Japan . | |
| 929905 | 6/1963 | United Kingdom . | |
| 1508198 | 4/1978 | United Kingdom . | |
| 2070459A | 9/1981 | United Kingdom | 427/402 |

*Primary Examiner*—Jeffery Thurlow

*Attorney, Agent, or Firm*—Sughrue, Mion, Zinn, Macpeak & Seas

[57] ABSTRACT

A method of simultaneously applying a plurality of liquid coating compositions to a moving web by the method of multi-layer coating; wherein the lowermost layer is comprised of water, with the wet coverage of water on the web being 2 $cm^3$ or less per square meter ($m^2$) of the web, and the layer immediately above the lowermost layer comprising a water-soluble coating solution having a viscosity greater than water and which is greater in thickness than the lowermost layer.

9 Claims, 1 Drawing Sheet

METHOD OF MULTI-LAYER COATING

BACKGROUND OF THE INVENTION

This invention relates to a method of applying coating solutions on support materials (hereinafter referred to as "a web", when applicable) in the manufacture of photographing photo-sensitive materials such as photographic papers, photographic materials for printing such as lithographic film and printing plate, and recording materials such as pressure-sensitive recording sheets and heat-sensitive recording sheets. More particularly, this invention relates to a method of multi-layer coating at least two coating liquids to a moving web.

One example of a high speed coating method for a slide hopper-type coating apparatus according to a multi-layer coating of this type has been disclosed in U.S. Pat. No. 4,001,024. In this method, the wet coverage of the lowermost layer is in the range from about 2 to about 12 cubic centimeters of coating composition per square meter of web surface and the lowermost layer is formed from a coating composition with a viscosity in the range from about 1 to about 8 centipoises, and the vortical action of the coating bead is confined within the lowermost layer and the layer immediately above it, whereby interlayer mixing occurs between the lowermost layer and the layer immediately above it but all other layers are coated in distinct layer relationship.

In U.S. Pat. No. 4,113,903, a coating method is disclosed in which the layer next to the web a shear thinning carrier layer of pseudoplastic liquid having a viscosity between 20 and 200 centipoises at a shear rate of 100 $sec^{-1}$ and a viscosity below 10 centipoises at a shear rate of 100,000 $sec^{-1}$. That is, in this method, the lowermost layer is formed of a pseudoplastic solution having a high viscosity with a low rate of shear and a low viscosity with a high rate of shear, in order to eliminate the instability of the bead in the U.S. Pat. No. 4,001,024.

In the above-described coating method, the coating solution forming the lowermost layer shows a non-Newtonian fluidity. Therefore, the coating solution must be prepared by using special compounds.

SUMMARY OF THE INVENTION

The present inventor has conducted extensive research on a method of achieving a high speed coating operation by using a low viscosity solution for formation of the lowermost layer, and has found that where the lowermost layer is made extremely thin by using water (which shows a Newtonian fluidity), with the wet coverage of water on the web set to 2 $cm^3$ or less per square meter ($m^2$) of the web surface, not only can the high speed coating operation be achieved as required, but also, the above-noted difficulty relating to the mixing of the lowermost layer and the next layer formed on it by the vortex at the bead, is eliminated.

The inventor has further found that, the coating operation performed in the above-described manner is effective in eliminating a further difficulty which is also well known in the art. That is, when a high-speed coating operation is carried out with a slide hopper type coating apparatus, coating streaks are formed on the coated surface in such a manner that they occur considerably regularly at intervals of several millimeters (mm), and are extended in the direction of conveyance of the web (cf., Japanese Unexamined Pat. application Publication No. 255172/1985).

Accordingly, an object of this invention is to provide a novel multi-layer coating method in which the already-described difficulties which accompany a conventional multi-layer coating method have been eliminated.

That is, in accordance with the method of the present invention, the lowermost layer and the layer immediately above it will never be mixed, no special and expensive compounds will be required for formation of the lowermost layer, any increase in the drying time will be minimized, and the coating operation can be achieved quickly and with high stability.

The foregoing object and other objects of the invention have been achieved by the provision of the present multi-layer coating method, which comprises applying at least two coating liquids to a moving web; wherein the coating liquid forming the lowermost layer is comprised of water, with the wet coverage of water on the web being 2 $cm^3$ or less, per square meter ($m^2$) of the web, and the layer immediately above the lowermost layer comprising an aqueous or water soluble coating solution having a viscosity greater than water and which is greater in thickness than the lowermost layer.

The nature, principle and utility of the invention will become more apparent from the following detailed description when read in conjunction with the accompanying drawings.

DETAILED DESCRIPTION OF THE INVENTION

The coating solutions used in this invention are generally water soluble coating solutions which, for instance, in the manufacture of photographing photosensitive materials, contain a small amount of organic solvent to form photo-sensitive emulsion layers, subbing layers, protective layers, back layers, and anti-halation layers.

Examples of the material used to form a support or web used in the present invention are paper, plastic film, resin-coated paper, synthetic paper and metal film.

Examples of materials used to form the plastic film are polyolefins such as polyethylene or polypropylene, vinyl polymers such as polyvinyl acetate, polyvinyl chloride or polystyrene, polyamide such as 6,6-nylon or 6-nylon, polyesters such as polyethylene terephthalate or polyethylene-2,6-naphthalate, polycarbonate, and cellulose acetates such as cellulose triacetate or cellulose diacetate. A typical example of a material used to form the resin-coated paper is polyolefin; however, the invention is not limited thereto or thereby. An example of a metal web is an aluminum web.

In the invention, distilled water is generally used to form the lowermost layer. It is preferred that the wet coverage of water on the web is 2 $cm^3$ or less, per square meter ($m^2$) of the web surface.

It is preferable that the layer immediately above the lowermost layer is at least five (5) times as large as the lowermost layer in thickness, and is at least fifteen (15) times as large as the lowermost layer in viscosity.

Preferred embodiments of this invention will be described with reference to the accompanying drawings.

Figure 1:
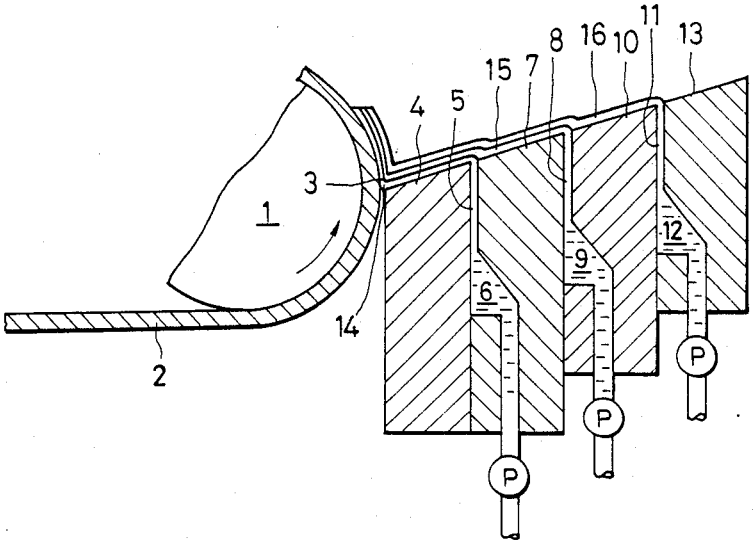
FIG. 1 is a sectional side view showing essential components of a slide hopper type coating apparatus which employs a multi-layer coating method according to this invention.

FIG. 1 is a sectional side view showing a slide hopper type coating apparatus for simultaneously applying three layers on a web according to the method of the present invention.

In FIG. 1, 1 designates a backup roll; 2, a web; 3, a bead region; 4, 7, 10 and 13, slide surfaces; 5, 8 and 11, slots; 6, 9 and 12, manifolds; 14, a water forming the lowermost layer; 15, a coating solution forming the first layer; and 16, a coating solution forming the second layer.

The web 2 is continuously conveyed on the backup roll 1 in the direction of the arrow by web conveying means (not shown). The water 14, which forms the lowermost layer, is supplied into the manifold 6 by means of a liquid supplying pump, where it is spread over the width of the hopper. The water thus spread, passes through the slot 5 to appear on the slide surface 4. Then, the water flows down the slide surface by its own weight to form the bead 3, thus being applied on the web 2. In this operation, the wet coverage of water applied to the web 2 is 2 $cm^3$ or less per square meter ($m^2$) of the web 2.

Similarly, the first and second layers are formed on the lowermost layer of water. More specifically, the coating solutions 15 and 16 are passed through the manifolds 9 and 12 and the slots 8 and 11 to appear on the slide surfaces 7 and 10, respectively. Then, the coating solutions 15 and 16 flow down the slide surfaces 7 and 10 by their own weight, thus forming the first an second layers, respectively. The coating solution films together with the water 14 are applied, in a form of multiple layers, to the web 2 while forming the bead 3.

Figure 2:
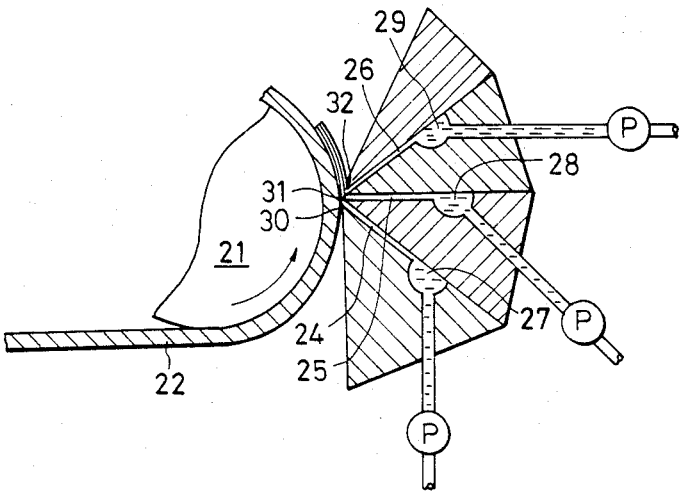
FIG. 2 is a sectional side view showing essential components of an extrusion type coating apparatus which employs the method of the invention.

FIG. 2 is a sectional side view showing an extrusion type coating apparatus for simultaneously applying three layers to a web according to the method of the present invention.

In FIG. 2, 21 designates a backup roll; 22, a web; 24, 25 and 26, slots; 27, 28 and 29, manifolds; 30, a water which forms the lowermost layer; 31, a coating solution which forms the first layer of a product; and 32, a coating solution which forms the second layer of the product.

The web 22 is continuously conveyed on the backup roll 21 in the direction of the arrow by web conveying means (not shown). The water, which forms the lowermost layer 30, is supplied into the manifold by a liquid supplying pump, where it is spread over the width of the hopper. The water thus spread is extruded through the slot 24, thus being applied to the web 22. In this operation, the wet coverage of water applied to the web is 2 $cm^3$ or less per square meter ($m^2$) of the web surface.

Similarly, the coating solutions 31 and 32, which form the first and second layers, are extruded through the manifolds 28 and 29 and the slots 25 and 26, respectively. The coating solutions thus extruded, together with the water 30, are applied to the web 22.

As described above, according to the present invention, the lowermost layer on the web is formed of water, and the wet coverage of water on the web is controlled to 2 $cm^3$ or less per square meter ($m^2$) of the web surface. Therefore, since the web is suitably wetted by the lowermost layer, the coating solutions will never be mixed together by the vortex of the bead, and no streaks will be formed on the product by the lowermost layer. Subsequently, the product manufactured according to the invention is high in quality. In addition, the coating speed can be greatly increased.

As conducive to a full understanding of the invention, concrete examples together with comparison examples are described below. However, it should be understood that the present invention is not to be limited thereto.

Comparison of the method of the invention with the conventional method was carried out with the slide hopper type coating apparatus of FIG. 1 under the following conditions. The web used was composed of a triacetate cellulose (TAC) base, and its width was 18 cm.

COMPARISON EXAMPLE 1

Under the following conditions, the multi-layer coating set forth below was carried out:

First layer: an anti-halation solution containing an anionic surface active agent having a viscosity of 60 cps at 40° C., applied at a flow rate of 75 cc/cm min.

Second layer: a gelatin solution containing an anionic surface active agent having a viscosity of 20 cps at 40° C., applied at a flow rate of 75 cc/cm min.

When, in this coating operation the coating speed was increased to 105 m/min, the coated surface was not uniform in quality.

EXAMPLE 1

Under the following conditions, the multi-layer coating set forth below was carried out:

Lowermost layer: water showing a viscosity of 0.65 cps at 40° C., applied at a flow rate of 2 cc/cm min.

First layer: same as the first layer in Comparison Example 1.

Second layer: same as the second layer in Comparison Example 1.

In the coating operation described above, with a coating speed up to 341 m/min, the coated surface was uniform in quality.

COMPARISON EXAMPLE 2

Under the following conditions, the multi-layer coating set forth below was performed:

First layer: an anti-halation solution of 60 cps at 40° C., applied at a flow rate of 57.6 cc/cm min.

Second layer: a gelatin solution of 8 cps at 40° C., applied at a flow rate of 38.4 cc/cm min.

In this coating operation, when the coating speed was 90 m/min, coating streaks were formed on the coated surface in such a manner that they occurred considerably regularly at intervals of several millimeters (mm), and were extended in the direction of conveyance of the web. That is, the resultant coated surface was not uniform in quality.

EXAMPLE 2

Under the following conditions, the multi-layer coating set forth below was carried out:

Lowermost layer: water having a viscosity of 0.65 cps at 40° C., applied at a flow rate of 2 cc/cm min.

First layer: same as the first layer in comparison Example 2,

Second layer: same as the second layer in Comparison Example 2.

In the coating operation, with the coating speed up to 300 m/min, no coating streaks were formed, and the coated surface was uniform in quality.

As shown by the Examples above, according to the method of the present invention, the lowermost layer is formed of water with the wet coverage of water on the web being set to 2 $cm^3$ or less per square meter ($m^2$) of the web surface, and the layer immediately above the lowermost layer are made of water soluble coating solution higher in viscosity than the water, in such a manner that they are larger in thickness than the lowermost layer. Therefore, the web is well wetted by the lowermost layer, and the bead formed is stable. Therefore, the lowermost layer will not mix with the other layers. In addition, the product is free from the difficulty shown by conventional methods, i.e., that the coating streaks are caused by the lowermost layer. Also, the coating speed can be greatly increased.

While the invention has been described in detail and with reference to specific embodiments thereof, it will be apparent to one skilled in the art that various changes and modification can be made therein without departing from the spirit and scope thereof.

What is claimed is:

1. A method of multi-layer coating in which at least two coating liquids are applied to a moving web, comprising:

applying the coating liquid forming the lowermost layer is composed of water, with the wet coverage of water on said web being 2 $cm^3$ or less per square meter ($m^2$) of said web; and applying the layer immediately above said lowermost layer comprising a water soluble coating solution having a viscosity greater than water and which is greater in thickness than said lowermost layer.

2. A method of multi-layer coating according to claim 1, in which the coating layer immediately above the lowermost layer is at least five times greater in thickness than said lowermost layer.

3. A method of multi-layer coating according to claim 1, wherein the coating layer immediately above the lowermost layer is at least 15 times greater in viscosity as said lowermost layer.

4. A method of multi-layer coating according to claim 1, wherein said lowermost layer is composed of distilled water.

5. A method of multi-layer coating according to claim 4, wherein the coating layer immediately above the lowermost layer is at least 5 times greater in thickness than said lowermost layer.

6. A method of multi-layer coating according to claim 4, wherein the coating layer immediately above the lowermost layer is at least 15 times greater in viscosity than said lowermost layer.

7. A method of multi-layer coating in which at least two coating liquids are applied to a moving web, comprising the steps of:

(a) apply a first coating liquid being composed of distilled water to form the lowermost layer, with the wet coverage of water on said web being 2 $cm^3$ or less per square meter of said web; and (b) applying a second coating liquid immediately above said lowermost layer to form a second layer, said second coating liquid comprising a water soluble coating solution having a viscosity greater than water, said second layer being greater in thickness than said lowermost layer.

8. A method of multi-layer coating according to claim 7, wherein said second layer is at least 5 times greater in thickness than said lowermost layer.

9. A method of multi-layer coating according to claim 7, wherein said second layer is at least 15 times greater in viscosity than said lowermost layer.

* * * * *